US006892971B2

(12) United States Patent
Rieger et al.

(10) Patent No.: US 6,892,971 B2
(45) Date of Patent: May 17, 2005

(54) FUEL INJECTION VALVE

(75) Inventors: Franz Rieger, Aalen (DE); Fevzi Yildirim, Gerlingen (DE); Andreas Eichendorf, Schorndorf (DE); Günther Hohl, Stuttgart (DE); Michael Hübel, Gerlingen (DE); Jürgen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 43 days.

(21) Appl. No.: 10/381,622

(22) PCT Filed: May 16, 2002

(86) PCT No.: PCT/DE02/01758

§ 371 (c)(1),
(2), (4) Date: Sep. 4, 2003

(87) PCT Pub. No.: WO03/012284

PCT Pub. Date: Feb. 13, 2003

(65) Prior Publication Data

US 2004/0050977 A1 Mar. 18, 2004

(30) Foreign Application Priority Data

Jul. 27, 2001 (DE) ..... 101 36 808

(51) Int. Cl.[7] ..... B05B 1/30

(52) U.S. Cl. ..... 239/585.1; 239/585.4; 239/585.5; 251/129.15; 251/129.21; 335/266

(58) Field of Search ..... 239/584, 585.1, 239/585.4, 585.5; 251/129.15, 129.21; 335/266, 267, 268

(56) References Cited

U.S. PATENT DOCUMENTS

| | | | | |
|---|---|---|---|---|
| 3,942,485 A | | 3/1976 | Inui et al. | |
| 4,275,693 A | | 6/1981 | Leckie | |
| 5,915,624 A | * | 6/1999 | Coldren et al. | 251/129.21 |
| 6,065,684 A | | 5/2000 | Varble et al. | |
| 6,113,014 A | * | 9/2000 | Coldren et al. | 239/585.1 |
| 6,167,869 B1 | * | 1/2001 | Martin et al. | 251/129.21 |
| 6,405,940 B2 | * | 6/2002 | Harcombe et al. | 239/585.1 |

FOREIGN PATENT DOCUMENTS

| | | |
|---|---|---|
| DE | 23 06 007 | 9/1973 |
| DE | 23 30 423 | 1/1974 |
| DE | 198 49 210 | 4/2000 |
| EP | 459999 | 12/1991 |
| JP | 11 062710 | 6/1999 |
| WO | WO 01 25614 | 4/2001 |

* cited by examiner

*Primary Examiner*—Steven J. Ganey
(74) *Attorney, Agent, or Firm*—Kenyon & Kenyon

(57) ABSTRACT

A fuel injector, in particular a fuel injector for fuel-injection systems of internal combustion engines, includes a first magnetic coil cooperating with a first armature, a second magnetic coil cooperating with a second armature, and a valve needle which is in force-locking connection with the first armature via a first flange and to the second armature via a second flange, to actuate a valve-closure member. A restoring spring acts upon the valve needle in a closing direction of the fuel injector. A first positioning spring, situated between the first flange and the first armature, acts upon the first armature in the closing direction of the fuel injector, while a second positioning spring, situated between the second flange and the second armature, acts upon the second armature in an opening direction of the fuel injector.

10 Claims, 3 Drawing Sheets

FUEL INJECTION VALVE

BACKGROUND INFORMATION

The closing times of fuel injectors are lengthened not only by adhesion forces between the armature and core but also by eddy currents. To reduce the delays, it is known, for example, to select a heavier design for the restoring spring acting upon the armature. To ensure that the opening times of the fuel injector will not be adversely affected by the increased restoring force of the restoring spring, stronger magnetic circuits must be developed which require larger dimensions of the magnetic coils, higher supply voltages, a greater number of turns per unit of length and more expensive magnet materials for their operation.

In addition, to speed up the decay of the residual field, it is known to allow a current to flow through the magnetic coil in the reverse direction once the current pulse energizing the fuel injector has come to an end. However, the construction of appropriate control elements is costly and shortens the closing times to a merely negligible extent.

Another possibility consists in generating one magnetic field for the opening of the fuel injector and a second magnetic field for holding the fuel injector in its open position. The strength of the holding field can then be selected to be so small that the eddy currents are low when the holding field is switched off, thereby allowing the closing time to be shortened.

From German Patent No. DE 23 06 007, an electromagnetically actuable fuel injector for injecting fuel into an internal combustion engine is known where the magnetic coil has three windings which are controlled by three separate switching circuits. The first switching circuit is used for the rapid opening of the fuel injector, the second switching circuit is used to keep the fuel injector open; and the third switching circuit is used to generate a demagnetizing field so as to decay the residual magnetic field for the rapid closing of the fuel injector.

A disadvantage of the fuel injector known from German Patent No. DE 23 06 007, in particular, is the costly manufacture of a system having three switching circuits controlling three windings of the magnetic coil. The increased space required by the switching circuits is an additional disadvantage. An active restoration by a magnetic force component acting in the closing direction does not take place.

SUMMARY OF THE INVENTION

The fuel injector of the present invention has the advantage over the related art that, due to the combination of a double-coil concept and the principle of the armature-free path which, by one prestroke and one positioning spring for each magnetic coil, allows a rapid opening operation and an active and, thus, accelerated closing operation, so that a fuel injector is able to be realized which has low activation outputs of the magnetic circuits and high switching dynamics.

It is also advantageous that the spring constants of the positioning springs are low compared to the spring constants of the restoring spring, thereby obviating a strengthening of the restoring spring.

By using two flanges which are in force-locked connection with the valve needle, in combination with the weak positioning springs, an armature free-path system is able to be realized that is mechanically simple and cost-effective.

The free paths of the armature advantageously amount to approximately half the total lift of the armatures of the magnetic circuit, so that the armatures are kept in oscillating center positions by an appropriately adjusted timing, which results in high switching dynamics.

DETAILED DESCRIPTION

Figure 1:
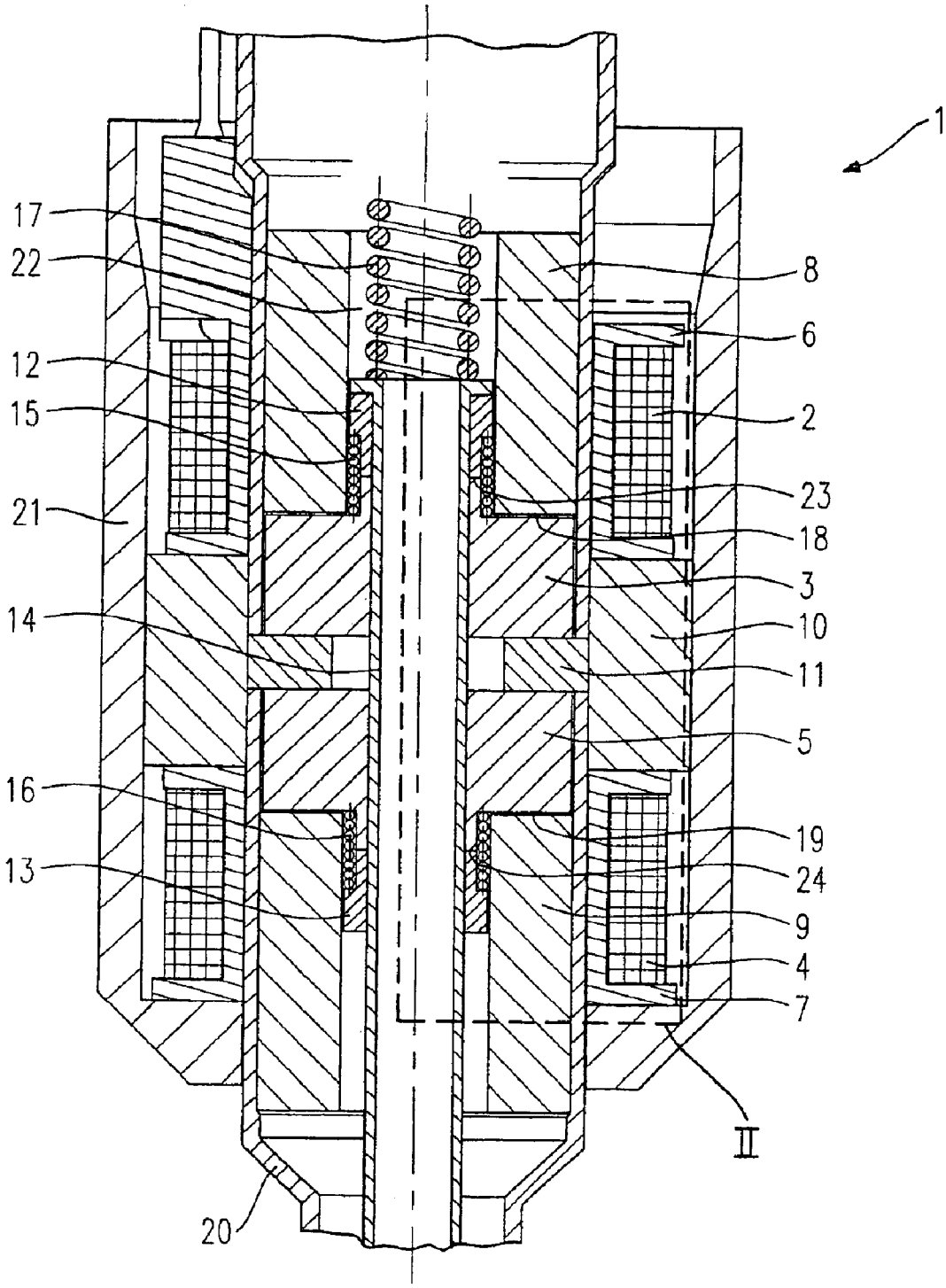
FIG. 1 shows a part-sectional view of an exemplary embodiment of a fuel injector according to the present invention.

FIG. 1 shows a part-sectional view of the center section of a fuel injector 1. Fuel injector 1 is used especially for the direct injection of fuel into the combustion chamber (not shown) of a mixture-compressing internal combustion engine having externally supplied ignition. Fuel injector 1 may be implemented as an inwardly opening or an outwardly opening fuel injector 1. Fuel injector 1 shown in FIG. 1 is a fuel injector that opens to the inside.

Fuel injector 1 includes a first magnetic coil 2 cooperating with a first armature 3, and a second magnetic coil 4 cooperating with a second armature 5. First magnetic coil 2 is wound on a first coil brace 6, and second magnetic coil 4 is wound on a second coil brace 7. First magnetic coil 2 is surrounded by a first core part 8, while second magnetic coil 4 is surrounded by a second core part 9. First magnetic coil 2 and second magnetic coil 4 are separated from one another in the axial direction by a segment 10. First armature 3 and second armature 5 are situated between first core part 8 and second core part 9 and are separated from one another by a stop ring 11. Stop ring 11 is made of a non-magnetizable material so as to magnetically separate the magnetic circuits.

A valve needle 14 penetrates through first core part 8, second core part 9 and both armatures 3 and 5. First armature 3 is in operative connection with valve needle 14 via a first flange 12, while second armature 5 is in operative connection to valve needle 14 via a second flange 13. Flanges 12 and 13 may be welded to valve needle 14 or may be pressed onto it. Braced between first flange 12 and first armature 3 is a first positioning spring 15, which acts upon first armature 3 in a closing direction. In the same way, a second positioning spring 16, which acts upon second armature 5 in an opening direction of fuel injector 1, is provided between second flange 13 and second armature 5.

In the closed state of fuel injector 1, a first working gap 18 is formed between first armature 3 and first core part 8, due to positioning springs 15 and 16, while a second working gap 19 is located between second armature 5 and second core part 9. Armatures 3 and 5 rest against stop ring 11. Located between first flange 12 and first armature 3 is a first armature free path 23, and formed between second flange 13 and second armature 5 is a second armature free path 24.

Braced on valve needle 14, in the intake direction, is a restoring spring 17 which acts upon valve needle 14 in such a way that a valve closure member (not shown further), which is in operative connection with valve needle 14, is sealingly held at a sealing seat, thereby holding fuel injector 1 closed. The spring constant of restoring spring 17 is much greater than the spring constants of positioning springs 15 and 16.

In addition, fuel injector 1 includes a nozzle body 20 penetrating an outer pole 21 of the magnetic circuits. Fuel is centrally supplied and conveyed to the sealing seat through a central opening 22 of fuel injector 1 and also through tubular valve needle 14.

Figure 2:
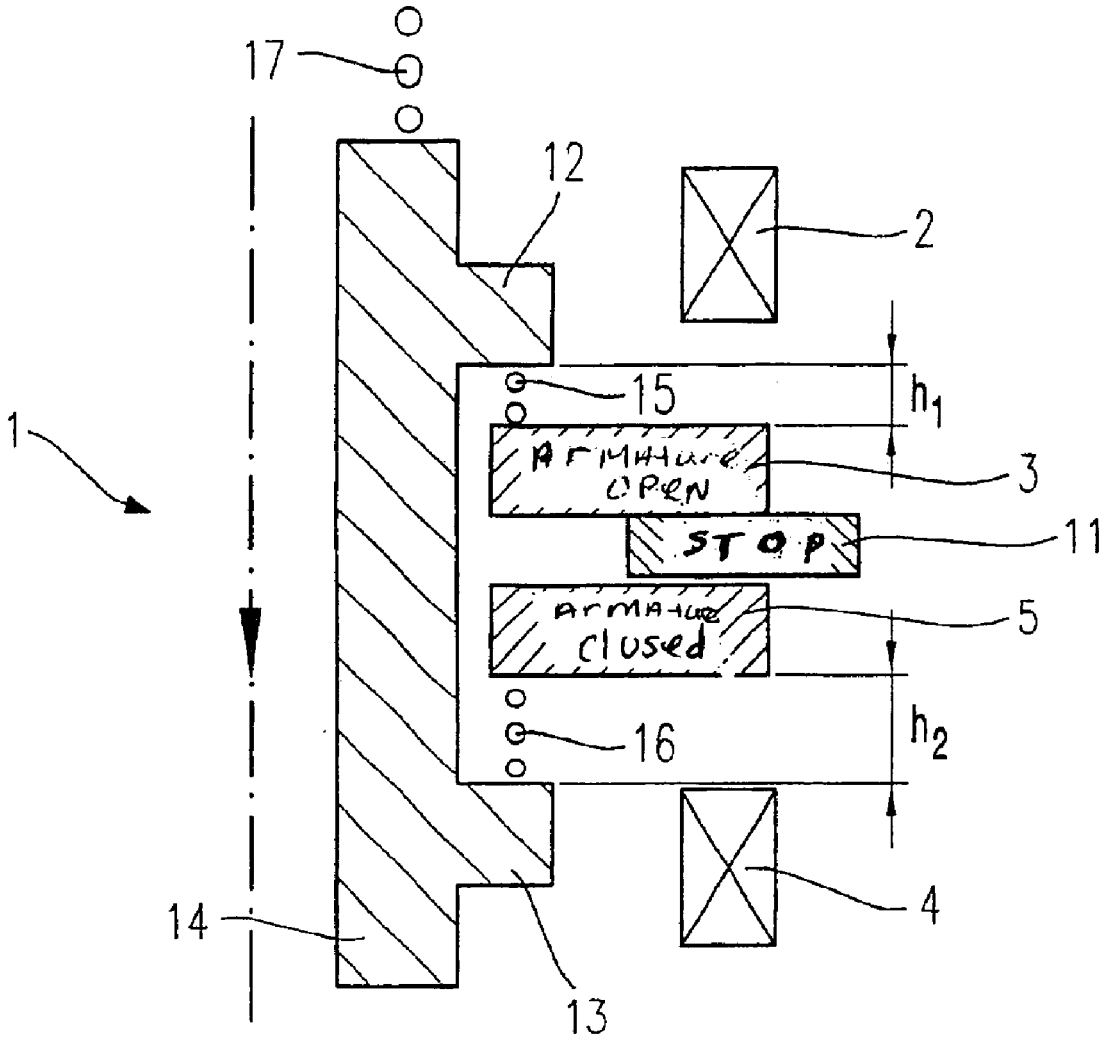
FIG. 2 shows a heavily schematized cut-away portion, in the area 11 of FIG. 1, of the fuel injector constructed according to the present invention.
Figure 3A:
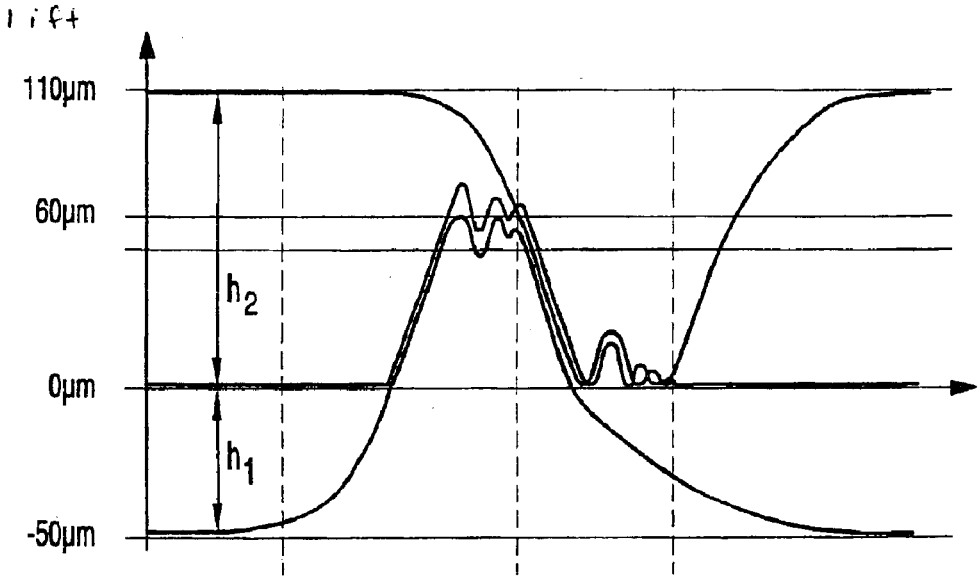
FIG. 3A shows a diagram of the time characteristic of the armature lift and valve needle lift of the exemplary embodiment of a fuel injector configured according to the present invention as shown in FIG. 1.
Figure 3B:
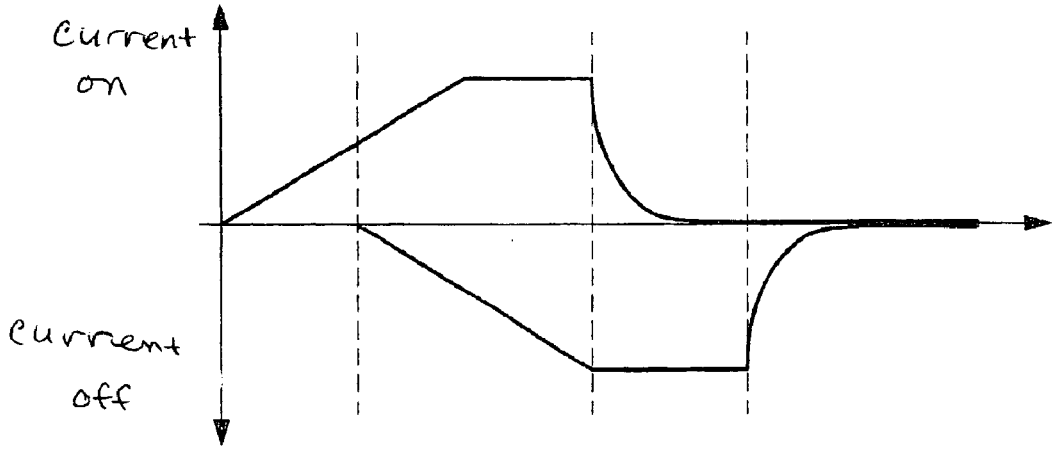
FIG. 3B shows a diagram of the switching phases of the exemplary embodiment of a fuel injector according to the present invention as shown in FIG. 1.

A detailed description of the functioning method and the dynamics of fuel injector 1 and the measures according to the present invention may be gathered from FIGS. 2 and 3A through 3B as well as from the following description.

FIG. 2, in a part-sectional view, shows a heavily schematized detail of the exemplary embodiment of a fuel injector 1 configured according to the present invention and described in FIG. 1, which illustrates working gaps 18 and 19 and armature free paths 23 and 24. The drawing shows only those parts of fuel injector 1 which are needed to explain the operating mode. Previously described elements have been given matching reference numerals. For the sake of clarity, the following description of the functioning method of magnetic coils 2 and 4 and of armatures 3 and 5 is to be viewed together with the diagrams shown in FIGS. 3A and 3B, which represent the time characteristic of the armature lift and the valve-needle lift of the exemplary embodiment of a fuel injector 1 configured according to the present invention as shown in FIG. 1, and also the switching phases of the opening and closing operation.

When, given a closed fuel injector 1, power is initially supplied to first magnetic coil 2, which is denoted by "armature open" in FIG. 2, the current energizing first magnetic coil 2, and denoted by "current on" in FIG. 3B, rises to a holding-current intensity. As soon as a sufficient magnetic force is obtained, first armature 3 is attracted by first core part 8 and moved in an opening direction. Valve needle 14, due to the restoring force of restoring spring 17 and due to armature free path 23 formed between first flange 12 and first armature 3, still remains in its original position. In the meantime, first armature 3 moves in the opening direction by a first lift, denoted by $h_l$ in FIGS. 2 and 3A, at valve needle 14. First lift $h_l$ is smaller than first working gap 18 formed between first armature 3 and first core part 8. After first armature 3 strikes first flange 12, valve needle 14 is taken along in the opening direction by first flange 12 to which it is joined by force-locking, thereby completely closing first working gap 18 and causing first armature 3 to strike against first core part 8.

In a typical exemplary embodiment of fuel injector 1 configured according to the present invention, the total width of working gaps 18 and 19 may amount, for instance, to approximately 110 $\mu$m, of which approximately 50 $\mu$m is taken up by prestrokes $h_1$ and $h_2$, respectively.

With the beginning of the movement of valve needle 14, the injection of fuel into the combustion chamber (not shown further) of the internal combustion engine commences as well.

When energizing first magnetic coil 2, second magnetic coil 4 is energized already as well. In the process, the magnetic field is built up such that second armature 5 is already moved in a closing direction of fuel injector 1. Second armature 5, denoted by "armature closed" in FIG. 2, travels a second lift, which is denoted by $h_2$ in FIGS. 2 and 3A. Subsequently, second armature 5 strikes second flange 13. During the prestroke phase of second armature 5, the current energizing first magnetic coil 2 is switched off. This causes valve needle 14 to be released from first armature 3. After second armature 5 strikes against first flange 13, the closing operation of valve needle 14 is initiated, aided by the force of restoring spring 17.

In the meantime, first armature 3, due to the force of first positioning spring 15, has already returned to its original position where it remains until the next opening cycle. After second magnetic coil 4 has been switched off, second positioning spring 16 is able to restore second armature 5 to its original position as well.

It can be seen in FIG. 3A that, following the respective travels of first and second lifts $h_1$ and $h_2$, armatures 3 and 5 are kept in an oscillating suspended state, so that a preacceleration of valve needle 14 during the opening and closing of fuel injector 1 may be dispensed with and the switching dynamics are considerably improved.

The simultaneous current application to both magnetic coils 2 and 4, which is shown in FIG. 3B, may be mutually adjusted in its timing in such a way that the closing operation is already initiated while the opening operation has not yet been completed.

Utilizing the described measures, therefore, makes it possible, through a combination of a double-coil concept and the principle of the armature free path, to realize a rapidly opening and rapidly closing fuel injector 1 which combines improved dynamics with a closing operation that is independent of bounce and enhanced by an active closing pulse of second armature 5, with low supply voltages and a reduced spring force of restoring spring 17.

The present invention is not limited to the described exemplary embodiment, but is also suited for a plurality of other types of configurations of fuel injectors 1, particularly also for fuel injectors 1 opening toward the outside.

What is claimed is:

1. A fuel injector for a fuel injection system of an internal combustion engine comprising:

a first armature;

a first magnetic coil cooperating with the first armature;

a second armature;

a second magnetic coil cooperating with the second armature;

a first flange;

a second flange;

a valve closure member;

a valve needle, joined by force-locking to the first armature via the first flange and to the second armature via the second flange, to activate the valve closure member;

a restoring spring acting upon the valve needle in a closing direction of the fuel injector;

a first positioning spring situated between the first flange and the first armature and acting upon the first armature in the closing direction of the fuel injector; and a second positioning spring situated between the second flange and the second armature and acting upon the second armature in an opening direction of the fuel injector.

2. The fuel injector according to claim 1, wherein the first and second positioning springs have a spring constant that is substantially lower than a spring constant of the restoring spring.

3. The fuel injector according to claim 1, wherein a first armature free path is formed between the first flange and the first armature.

4. The fuel injector according to claim 3, further comprising a first core part, the first armature free path being smaller than a first working gap formed between the first armature and the first core part.

5. The fuel injector according to claim 4, wherein a second armature free path is formed between the second flange and the second armature.

6. The fuel injector according to claim 5, further comprising a second core part, the second armature free path being smaller than a second working gap formed between the second armature and the second core part.

7. The fuel injector according to claim 6, wherein the first and second armature free paths are about 50 $\mu$m, and a width of the first and second working gaps is about 100 $\mu$m.

8. The fuel injector according to claim 1, wherein the first and second flanges are joined to the valve needle by force-locking.

9. The fuel injector according to claim 1, wherein the first and second magnetic coils build up magnetic fields which act in opposite directions.

10. The fuel injector according to claim 1, further comprising a stop ring composed of a non-magnetizable material and situated between the first armature and the second armature.

* * * * *